US009764876B2

(12) United States Patent
Balazs et al.

(10) Patent No.: US 9,764,876 B2
(45) Date of Patent: Sep. 19, 2017

(54) SLEEVE PACK ASSEMBLY

(71) Applicant: ORBIS Corporation, Oconomowoc, WI (US)

(72) Inventors: Donald J. Balazs, Oconomowoc, WI (US); Scott Buss, Watertown, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/985,655

(22) Filed: Dec. 31, 2015

(65) Prior Publication Data

US 2016/0194110 A1 Jul. 7, 2016

Related U.S. Application Data

(60) Provisional application No. 62/099,263, filed on Jan. 2, 2015, provisional application No. 62/099,829, filed on Jan. 5, 2015.

(51) Int. Cl.

| | |
|---|---|
| ***B65D 19/12*** | (2006.01) |
| ***B65D 19/44*** | (2006.01) |
| ***B65D 19/00*** | (2006.01) |
| ***B65D 19/06*** | (2006.01) |

(52) U.S. Cl.

CPC ..... *B65D 19/44* (2013.01); *B65D 19/0004* (2013.01); *B65D 19/06* (2013.01); *B65D 2519/00174* (2013.01); *B65D 2519/00208* (2013.01); *B65D 2519/00497* (2013.01); *B65D 2519/00661* (2013.01)

(58) Field of Classification Search

CPC ..... B65D 19/18; B65D 71/0096; B65D 2519/00975

USPC ..... 220/4.26, 4.27; 206/600, 599

See application file for complete search history.

(56) References Cited

U.S. PATENT DOCUMENTS

| | | | | |
|---|---|---|---|---|
| 3,374,915 | A | 3/1968 | Verhein et al. | |
| 3,650,459 | A * | 3/1972 | Tucker | B65D 19/20 206/591 |
| 3,926,412 | A | 12/1975 | Beretta | |
| 3,966,072 | A | 6/1976 | Gonzales et al. | |
| 4,030,600 | A * | 6/1977 | Heaps | B65D 19/20 206/586 |
| 4,221,296 | A | 9/1980 | Fell et al. | |
| 4,626,155 | A | 12/1986 | Hlinsky et al. | |
| 4,720,013 | A | 1/1988 | Nichols et al. | |
| 4,746,053 | A | 5/1988 | Nichols | |

(Continued)

FOREIGN PATENT DOCUMENTS

| | | | |
|---|---|---|---|
| DE | 102005031526 | A1 | 4/2007 |
| EP | 2256051 | A1 | 12/2010 |

(Continued)

OTHER PUBLICATIONS

European Patent Office, Extended European Search Report for EP Application No. EP 14150885.3 mailed Jul. 3, 2014 (7 pages).

(Continued)

*Primary Examiner* — King M Chu

(74) *Attorney, Agent, or Firm* — Greensfelder, Hemker & Gale, P.C.

(57) ABSTRACT

A sleeve pack (10) is disclosed having a pallet (50) and top cap (80) with one or more dividers (60) disposed therebetween and one or more sleeves (70) disposed between the pallet (50) and each divider (60) or top cap (80).

20 Claims, 4 Drawing Sheets

(56) References Cited

U.S. PATENT DOCUMENTS

| | | | |
|---|---|---|---|
| 4,798,290 | A | 1/1989 | Bradford |
| 4,966,280 | A | 10/1990 | Bradford |
| 5,017,260 | A | 5/1991 | Bardford |
| 5,037,027 | A | 8/1991 | Nichols |
| 5,109,985 | A | 5/1992 | Rose |
| 5,295,632 | A | 3/1994 | Zink et al. |
| 5,462,221 | A | 10/1995 | Zink et al. |
| 5,522,539 | A | 6/1996 | Bazany |
| 5,538,178 | A | 7/1996 | Zink et al. |
| 5,597,084 | A | 1/1997 | Parasin |
| 5,597,113 | A | 1/1997 | Bradford |
| 5,638,983 | A | 6/1997 | Bazany |
| 5,722,328 | A | 3/1998 | Darby |
| 5,725,118 | A | 3/1998 | Slager et al. |
| 5,725,119 | A | 3/1998 | Bradford et al. |
| 5,732,876 | A | 3/1998 | Bradford |
| 5,788,146 | A | 8/1998 | Bradford et al. |
| 5,813,566 | A | 9/1998 | Bradford et al. |
| 5,862,917 | A | 1/1999 | Noble et al. |
| 5,908,135 | A | 6/1999 | Bradford et al. |
| 6,024,223 | A | 2/2000 | Ritter |
| 6,305,601 | B1 | 10/2001 | Bazany et al. |
| 6,349,877 | B1 | 2/2002 | Bradford |
| D454,692 | S | 3/2002 | Bublitz |
| D455,266 | S | 4/2002 | Bradford |
| 6,460,724 | B1 | 10/2002 | Bradford |
| 6,540,096 | B1 | 4/2003 | Bazany et al. |
| 6,547,127 | B2 | 4/2003 | Bradford et al. |
| 6,564,993 | B1 | 5/2003 | Wassink |
| 6,592,025 | B2 | 7/2003 | Bazany et al. |
| 6,619,540 | B1 | 9/2003 | Bazany |
| 6,902,061 | B1 | 6/2005 | Elstone |
| 7,083,369 | B2 | 8/2006 | Nyeboer |
| 7,258,232 | B2 | 8/2007 | Bradford et al. |
| 7,322,485 | B2 | 1/2008 | Bradford et al. |
| 7,344,043 | B2 | 3/2008 | Nyeboer |
| 7,344,044 | B2 | 3/2008 | Bradford et al. |
| 7,360,663 | B2 | 4/2008 | Vroon |
| 7,380,358 | B2 | 6/2008 | Bazany et al. |
| 7,410,094 | B2 | 8/2008 | Bos |
| 7,428,975 | B2 | 9/2008 | Bradford |
| 7,503,462 | B2 | 3/2009 | Vroon |
| 7,540,390 | B2 | 6/2009 | Bublitz et al. |
| 7,556,170 | B2 | 7/2009 | Vroon |
| 7,644,830 | B2 | 1/2010 | Vroon |
| 7,644,831 | B2 | 1/2010 | Vroon |
| 7,654,408 | B2 | 2/2010 | Bazany |
| 7,748,559 | B2 | 7/2010 | Bradford |
| 7,748,803 | B2 | 7/2010 | Bazany et al. |
| 7,762,422 | B2 | 7/2010 | Dobrinski |
| 7,774,919 | B2 | 8/2010 | Bublitz et al. |
| 7,775,419 | B2 | 8/2010 | Bale |
| 7,878,345 | B2 | 2/2011 | Tourlamain |
| 7,878,362 | B2 | 2/2011 | Nyeboer |
| 8,061,549 | B2 | 11/2011 | Nyeboer et al. |
| 8,079,490 | B2 | 12/2011 | Nyeboer et al. |
| 8,100,282 | B2 | 1/2012 | Nyeboer et al. |
| 8,100,283 | B2 | 1/2012 | Nyeboer et al. |
| 8,112,859 | B2 | 2/2012 | Vroon |
| 8,146,224 | B1 | 4/2012 | Vroon |
| 8,523,004 | B2 | 9/2013 | Vroon |
| 8,910,790 | B2 * | 12/2014 | Trickett ..... B65D 71/0088 206/497 |
| 2009/0032432 | A1 * | 2/2009 | Kostos ..... B65D 5/006 206/600 |
| 2014/0284247 | A1 | 9/2014 | Balazs et al. |

FOREIGN PATENT DOCUMENTS

| | | | |
|---|---|---|---|
| EP | 2783996 | A1 | 10/2014 |
| FR | 2126521 | A5 | 10/1972 |
| GB | 2440327 | A | 1/2008 |
| JP | 2008-308194 | A | 12/2008 |
| JP | 2009-107703 | A | 5/2009 |
| WO | 2006132613 | A1 | 12/2006 |

OTHER PUBLICATIONS

European Patent Office, Examination Report for EP Application No. EP 14150885.3 mailed Nov. 9, 2015 (4 pages).

* cited by examiner

The system starts with a reduced footprint Opte pallet at floor level and continues with a plurality of interlocking 3-sided sleeves and dividing caps used to define each vertical tier. All sleeves fold up flat and fit between the dividing caps and pallet in the collapsed state.

Alternate Embodiment

This system uses two three sided half sleeves and a top cap to completely encase the product when assembled. This embodiement is currently designed to be a two tier system.

"D" SIDE OF SLEEVE 70

SLEEVE PACK ASSEMBLY

CROSS-REFERENCE TO RELATED APPLICATIONS

The present invention claims the benefit of U.S. Provisional Patent Application No. 62/099,263 filed Jan. 2, 2015 and U.S. Provisional Patent Application No. 62/099,829 filed Jan. 5, 2015, the contents of which are incorporated herein by reference.

FEDERALLY SPONSORED RESEARCH OR DEVELOPMENT

N/A

FIELD OF THE INVENTION

The present invention generally relates to a sleeve pack assembly, and more particularly to a sleeve pack adapted for stacking.

BACKGROUND OF THE INVENTION

Returnable bulk containers come in two general classifications: sleeve packs and knock downs. A sleeve pack includes a pallet, a sleeve and a top cap. Sleeve packs are the most commonly used returnable bulk container in Europe, South East Asia, and South America. Engineered sleeve packs have superior shipping efficiency, hygienics, ergonomics, and reverse logistics, making them the best bulk solution for many applications. Specifically, sleeve packs provide: Shipping Efficiency—maximum amount of product per trailer load; Reverse Logistics—require less return freight; Hygienics—can be cleaned and sanitized (required for pharma, medical, caps & closures, and food); and Safety and Ergonomics—often safer, easier to use.

To assemble and disassemble a sleeve pack today, there are two options to retain (i.e., lock) the bottom portion of the sleeve to the pallet and the top portion of the sleeve to the top cap. These include: (1) a passive interference fit, and (2) an active latching mechanism.

The passive interference fit lock generally creates an engagement between the reusable sleeve and pallet and top frame. The active latching mechanism locks them in place. Recently developed active mechanisms are disclosed in U.S. patent application Ser. No. 14/039,040, filed Sep. 27, 2013, titled "Spring Loaded Latching Mechanism for Sleeve Pack Assembly," by Orbis Corporation, Oconomowoc, Wisc.

In distribution chains today it is common for products to be handled multiple times before they are put out for display, such as on shelves. Today, if there are multiple small orders on one pallet, these orders must be delivered in reverse order of their picking or selection. (Last In, First Out). For example, as shown in FIG. 1, a supplier first collects the items 11, 12, 13 to be palletized via a forklift 20 having spaced apart tines. This is typically accomplished on a single pallet 25 and typically in a warehouse. Next, as shown in FIG. 2, the items are stacked for transporting in trucks or railcars. This is often accomplished by stacking multiple pallets 25, 26 with their goods or items 11, 12, 13, 14, 15 thereon to maximize the truck/car loads for transport and shipping. Finally, once at the retailer's, customer's, or purchaser's place of business, as shown in FIG. 3, the palletized goods 11, 12, 13 must be unstacked from the pallets 25 and broken down to fit onto carts 21 that can maneuver within the retail outlet and shelved/displayed.

This approach is, of course, inefficient, costly and can, at times, be unsafe. Again, with multiple small orders, the order of unloading the products is controlled by the order of selecting the products. As a result, the present invention was developed to improve upon this supply process.

Further aspects of the invention are disclosed in the Figures, and are described herein.

SUMMARY OF THE INVENTION

The present invention provides an assembly for transporting goods. The assembly includes a pallet, one or more dividers and one or more sleeves, and a top cap.

In accordance with one embodiment of the invention, a sleeve pack assembly is provided. The sleeve pack assembly comprises a pallet and a top cap with a first divider disposed therebetween, a first sleeve disposed between the pallet and the first divider and a second sleeve disposed between the first divider and the top cap.

The first sleeve includes a first side, a second side and a third side. The first sleeve can also include a fourth side.

The fourth side can have a central opening. In this regard, the fourth side can include a frame having a top flange, a bottom flange, a first side flange and a second side flange. Alternatively, the fourth side can include a partial frame having only a top flange, a first side flange and a second side flange, or some other combination of flanges, such as only a first side flange and a second side flange.

The assembly can further comprise a second divider disposed between the first divider and the top cap. A third sleeve can be disposed between the second divider and the top cap.

The first divider can include channels on a lower surface of the divider, proximate side edges of the divider, for receiving a top portion of each of the sides of the first sleeve. Similarly, the first divider can include channels on an upper surface of the divider, proximate side edges of the divider, for receiving a bottom portion of each of the sides of the second sleeve. The divider can also include a latching mechanism for securing the top portions of the first sleeve to the first divider and for securing the bottom portions of the second sleeve to the first divider.

The sleeves are formed from a corrugated plastic material or other suitable materials. The pallet, dividers and top cap are preferably formed from plastic or other suitable materials.

In accordance with another embodiment, a sleeve pack assembly with two sleeves on a pallet is provided. The sleeve pack assembly comprises a pallet and a top cap, the pallet having a generally rectangular upper surface. The assembly also comprises a first sleeve disposed between the pallet and the top cap where the first sleeve has a first side, a second side connected at a first edge to the first side, and a third side connected to a second edge of the second side, and a second sleeve disposed between the pallet and the top cap where the second sleeve also has a first side, a second side connected at a first edge to the first side, and a third side connected to a second edge of the second side.

The first side of the first sleeve is configured to interlock with the third side of the second sleeve when both are set up on the pallet. Similarly, the third side of the first sleeve is configured to interlock with the first side of the second sleeve. Together, the first and second sleeves form a rectangular enclosure on the pallet.

The top cap can include channels for receiving a top portion of each of the sides of the first sleeve and a top portion of each of the sides of the second sleeve. Similarly, the pallet can include channels for receiving a bottom portion of each of the sides of the first sleeve and a bottom portion of each of the sides of the second sleeve. Both the pallet and top cap can also include a latching mechanism for securing the bottom or top portion, respectively, of each of the sides of the first sleeve and a bottom or top portion, respectively, of each of the sides of the second sleeve to the pallet.

Further aspects of the invention are disclosed in the Figures, and are described herein.

BRIEF DESCRIPTION OF THE DRAWINGS

To understand the present invention, it will now be described by way of example, with reference to the accompanying figures in which.

DETAILED DESCRIPTION

While this invention is susceptible of embodiments in many different forms, there is shown in the Figures, and will herein be described in detail preferred embodiments of the invention with the understanding that the present disclosure is to be considered as an exemplification of the principles of the invention and is not intended to limit the broad aspect of the invention to the embodiments illustrated.

Figure 3:
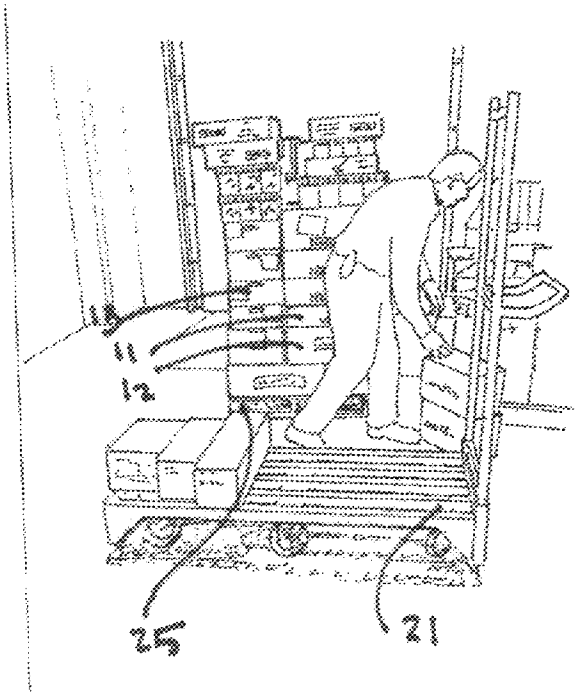
FIGS. 1, 2, and 3 show prior art supply chain structures and activities.
Figure 2:
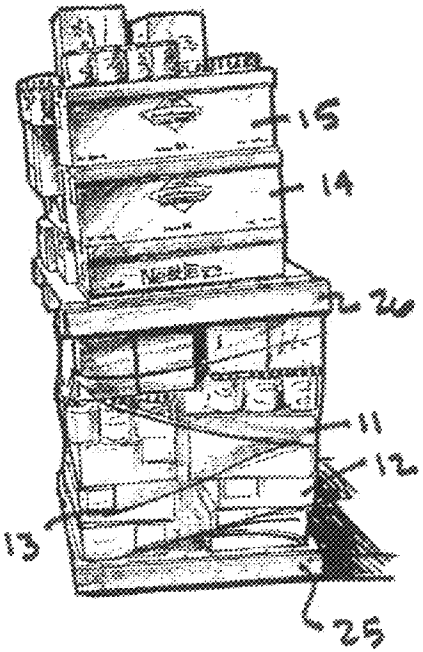
Figure 1:
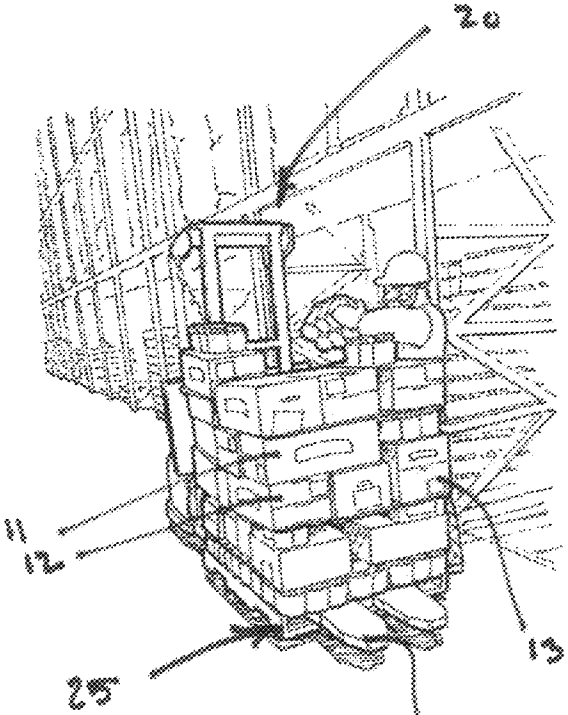
Figure 4:
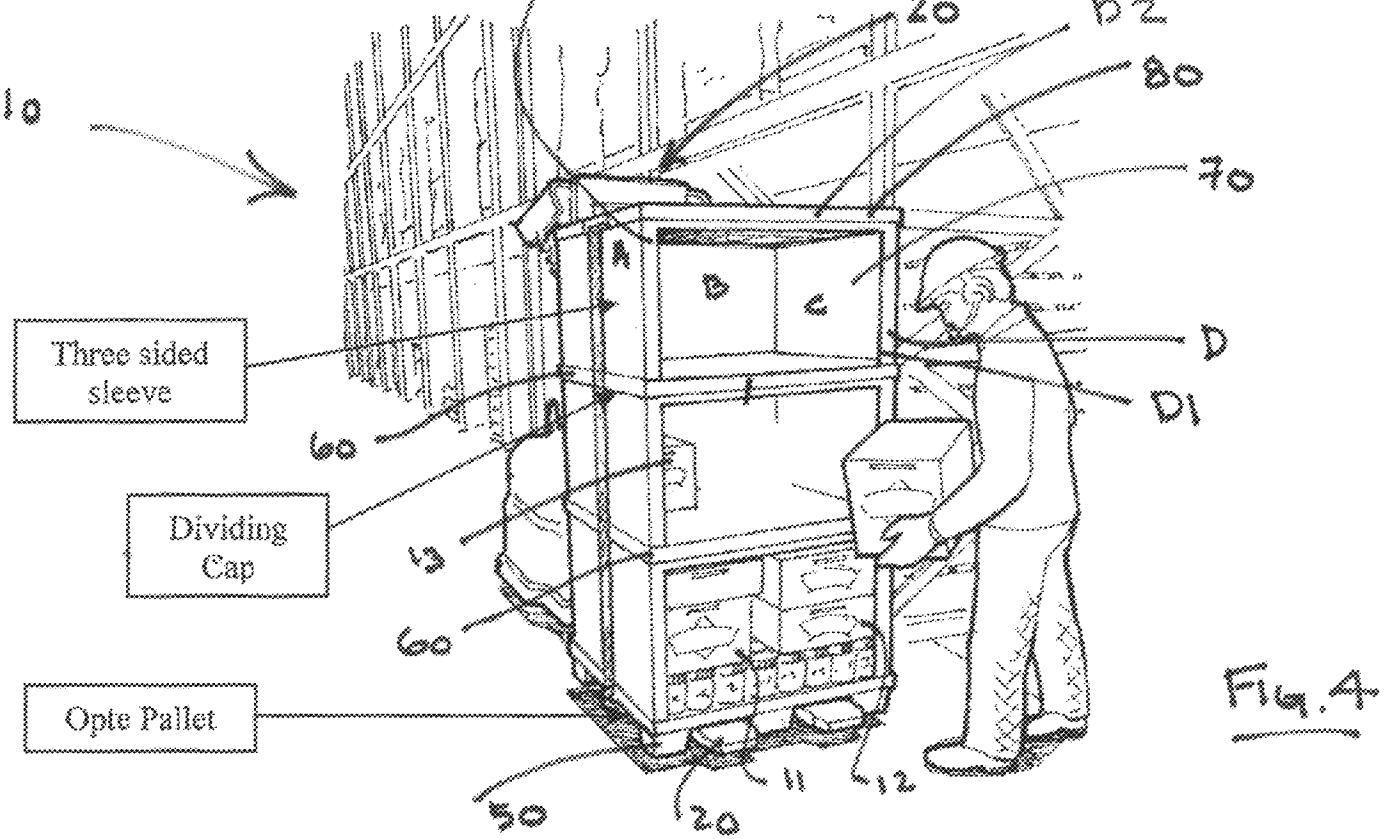
FIG. 4 is a general representation of a sleeve pack assembly made in accordance with the teachings of the present invention.
Figure 5:
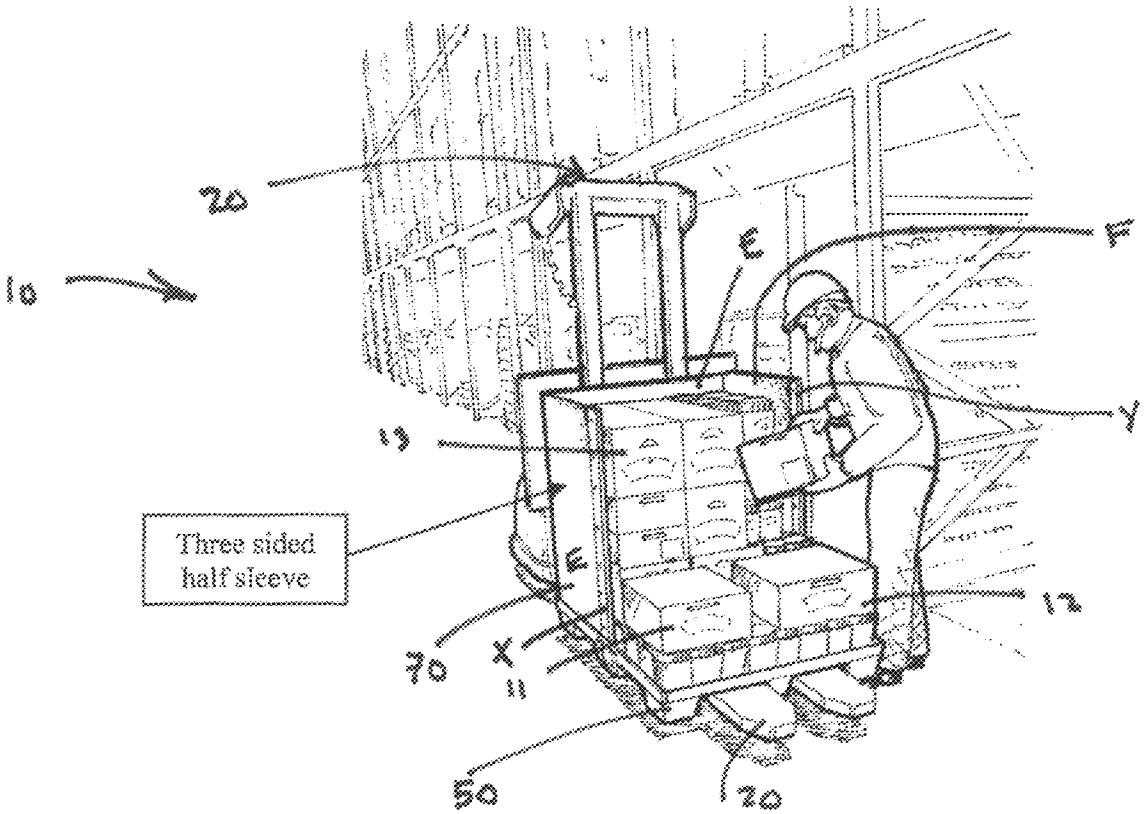
FIG. 5 is a further general representation of another embodiment of a sleeve assembly made in accordance with the teachings of the present invention; and, FIGS. 6, 7, and 8 show different configurations of Side D of the sleeves of the sleeve pack assembly of FIG. 4.
Figures 3, 4, 5:
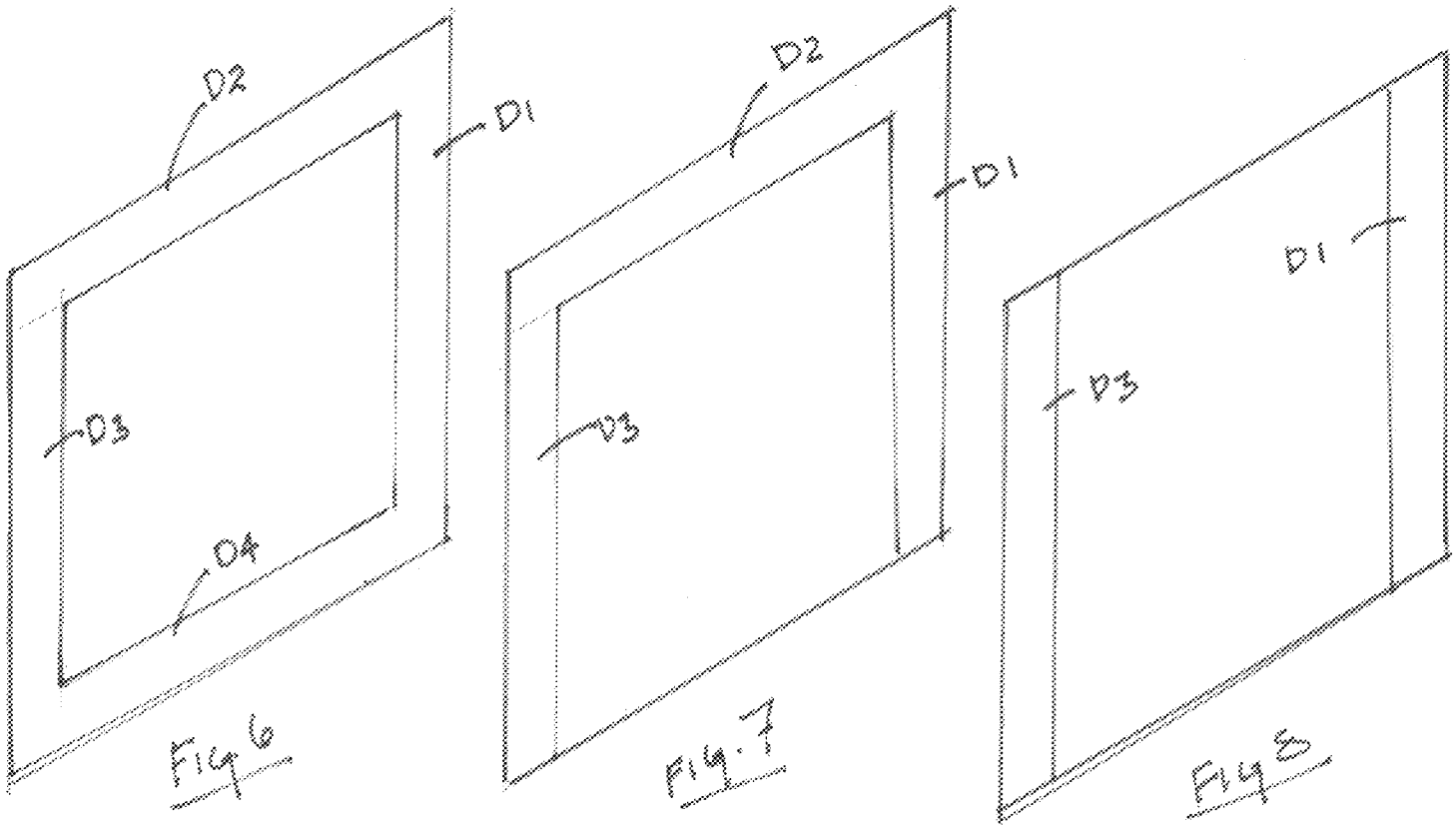

As illustrated in FIG. 4 and FIG. 5, the present invention 10 uses a base pallet 50, one or more dividing caps 60, and different foldable/collapsible sleeve configurations 70, and a top cap 80. FIG. 4 shows a three-tiered system 10 incorporating a single pallet 50, two dividing caps 60, three four-sided sleeves 70, and a single top cap 80. Each sleeve 70 has four sides A, B, C, D which have roughly the same footprint of the pallet (Sides A, B, C, D fit on the pallet 50 and dividers 60). The fourth side of the sleeve D can be open, or partially open. See FIGS. 6-8 which show configurations of side D of the sleeve 70 and the flanges D1, D2, D3, D4. As shown, the side can be set-up as a full frame (FIG. 6) or a partial frame (e.g., FIG. 7 or 8, or as a C-Shape or U-shape). The partial walls D permit visibility of the goods. In short, the fourth side D has an opening, such as a window cut-out formed by the flanges. In an alternative, the partial wall D may be totally removed and left open as in a three sided box (A, B, C).

It is recognized that the top cap 80 can also be a further dividing caps 60. Or, the divider sheets or dividing caps 60 can be top caps 80 so as to avoid multiple components. Thus, each layer of goods can be divided or separated by a top cap 80 and a top cap 80 can be used on the top of the stack of goods.

In addition, the pallet can be a mirror image design which allows the pallet to be used as either a supporting pallet on the bottom or a top cap on the top of the goods. The three tiers of product 11, 12, 13, can then be collected, transported, and stored until shelved or displayed. It should be noted, that the entire system can be strapped with a strap 90 around the pallet 50, sleeves 70, goods 11, 12, 13, dividers 60, and top cap 80. The top cap 80 and dividers 60 can include slots or clasps to secure the strap in place. The entire system can also be wrapped with film, also known as stretch film, pallet wraps, hand wraps, and stretch wraps, to prevent unwanted movement.

An alternative embodiment, partially shown in FIG. 5, includes single tiered system 10 incorporating a single pallet 50, no dividing caps 60, two three-sided half sleeves 70 (only one of which is shown for clarity purposes), and a single top cap 80 (Not shown). Each half sleeve 70 has three sides E, F, G that cover three sides of half the pallet and leave the inside side opened. Two confronting half sleeves interlocked together at the edges (X, Y) roughly has the same footprint of the pallet. If desired, a top cap 80 and/or dividers 60 can be used to set-up multiple tiers. Product 11, 12, 13, can then be collected, transported, and stored until shelved or displayed. As before, if desired, the entire system can be strapped with a strap around the pallet, sleeves, goods, dividers 60, and top cap. The top cap 80 and/or dividers 60 can include slots or clasps to secure the strap in place. The entire system can also be wrapped with film, also known as stretch film, pallet wraps, hand wraps, and stretch wraps, to prevent unwanted movement.

One significant advantage of the above system is that it can be in small format or customized formats. With a pallet at the bottom and a plurality of dividing caps, top cap, and sleeves above, a multiple tiered systems can be easily erected. The sleeves fold up and sandwich between the interlocking dividing caps and top cap and the pallet to create a dense, returnable, highly compact unit. The entire system can be designed for use with a standard sized pallet jack and can be used throughout the entire distribution chain. Or, if the aisle space of the retail establishment and width of doors are particularly important, the entire system can be customized and made (pallet size, sleeve size, divider size, and top cap size) specifically for that facility or facilities. Thus, the footprint of the pallet, sleeves, dividers, and top cap are customized to the customer or purchaser. As a result, the custom-sized assembly can be used in the entire supply chain for a particular customer or purchaser (e.g., from loading the pallets to finally shelving the product) by the supplier(s).

One important note is that the insulating ability of the sleeves specifically facilitates the transportation and storage of these systems and their contents in the area of frozen foods and frozen or refrigerated products.

The pallet is preferably injection-molded for precise dimensional consistency. It can have customized footprints (dimensions) depending on needs and sizing of palletizers, depalletizers, automatic strapping/banding systems, conveyors, and in-store carts. Similarly, the sleeves can have multiple custom heights and designs. Custom printing and graphics on the sleeves, pallets, dividers, and top caps are also used for easy identification. The sleeves can be corrugated or plastic corrugated materials. They can include drop panels, and can be split-sleeves and steel wire reinforced sleeves. The top cap is generally injection-molded, structural foam, or single sheet thermoformed. Top caps provide durability and performance for increased load integrity. When combined with pallets, top caps help to maintain the uniform weight distribution for secure load stacking, especially when used with seat belts.

The sleeves 70 are a single piece, or can be formed from two or more pieces, such as one commonly referred to as a C-sleeve. The sleeves 70 are foldable and can be folded and collapsed for more compact shipment when empty.

In general, the top surface of the pallet 50 and dividers 60 and bottom surface of the dividers 60 and top cap 80 include troughs or channels proximate their side edges for receiving a bottom portion or a top portion of the sleeves. The sleeves can be further locked into place with latching mechanisms in the pallet, dividers, and top cap.

Many modifications and variations of the present invention are possible in light of the above teachings. It is, therefore, to be understood within the scope of the appended claims the invention may be protected otherwise than as specifically described.

We claim:

1. A sleeve pack assembly comprising:

a pallet and a top cap with a first divider disposed therebetween;

a first sleeve disposed between the pallet and the first divider, the first sleeve including a first side, a second side, a third side and a fourth side wherein the fourth side has a central opening and a top flange, a bottom flange, a first side flange and a second side flange; and, a second sleeve disposed between the first divider and the top cap.

2. A sleeve pack assembly comprising:

a pallet and a top cap with a first divider disposed therebetween;

a first sleeve disposed between the pallet and the first divider, the first sleeve including a first side, a second side, a third side and a fourth side wherein the fourth side has a central opening and wherein the fourth side includes a partial frame having only a top flange, a first side flange and a second side flange; and, a second sleeve disposed between the divider and the top cap.

3. A sleeve pack assembly a pallet and a top cap with a first divider disposed therebetween;

a first sleeve disposed between the pallet and the first divider, the first sleeve including a first side, a second side, a third side and a fourth side wherein the fourth side has a central opening and wherein the fourth side includes a partial frame having only a first side flange and a second side flange; and, a second sleeve disposed between the divider and the top cap.

4. The sleeve pack assembly of claim 1 further comprising a second divider disposed between the first divider and the top cap.

5. The sleeve pack assembly of claim 4 further comprising a third sleeve disposed between the second divider and the top cap.

6. The sleeve pack assembly of claim 1 wherein the first divider includes channels on a lower surface proximate side edges of the divider for receiving a top portion of each of the sides of the first sleeve.

7. The sleeve pack assembly of claim 1 wherein the first divider includes channels on an upper surface proximate side edges of the divider for receiving a bottom portion of each of the sides of the second sleeve.

8. The sleeve pack assembly of claim 6 wherein the first divider includes a latching mechanism for securing the top portions of the first sleeve to the first divider.

9. The sleeve pack assembly of claim 7 wherein the first divider includes a latching mechanism for securing the bottom portions of the second sleeve to the first divider.

10. The sleeve pack assembly of claim 1 wherein the first sleeve is formed from a corrugated plastic material.

11. A sleeve pack assembly comprising:

a pallet and a top cap, the pallet having a generally rectangular upper surface;

a first sleeve disposed between the pallet and the top cap, the first sleeve having a first side, a second side connected at a first edge to the first side, and a third side connected to a second edge of the second side; and, a second sleeve disposed between the pallet and the top cap, the second sleeve having a first side, a second side connected at a first edge to the first side, and a third side connected to a second edge of the second side wherein the top cap includes channels for receiving a top portion of each of the sides of the first sleeve and a top portion of each of the sides of the second sleeve.

12. The sleeve pack assembly of claim 11 wherein the first side of the first sleeve interlocks with the third side of the second sleeve.

13. The sleeve pack assembly of claim 12 wherein the third side of the first sleeve interlocks with the first side of the second sleeve.

14. The sleeve pack assembly of claim 11 wherein the pallet includes channels for receiving a bottom portion of each of the sides of the first sleeve and a bottom portion of each of the sides of the second sleeve.

15. The sleeve pack assembly of claim 14 wherein the pallet includes a latching mechanism for securing the bottom portion of each of the sides of the first sleeve and a bottom portion of each of the sides of the second sleeve to the pallet.

16. A sleeve pack assembly comprising:

a pallet and a top cap with a first divider disposed therebetween;

a first sleeve disposed between the pallet and the first divider wherein the first sleeve includes a first side, a second side and a third side wherein the first divider includes channels on a lower surface proximate side edges of the divider for receiving a top portion of each of the sides of the first sleeve; and, a second sleeve disposed between the first divider and the top cap.

17. The sleeve pack assembly of claim 16 wherein the first divider includes a latching mechanism for securing the top portions of the first sleeve to the first divider.

18. A sleeve pack assembly comprising:

a pallet and a top cap with a first divider disposed therebetween;

a first sleeve disposed between the pallet and the first divider wherein the first sleeve includes a first side, a second side and a third side; and, a second sleeve disposed between the first divider and the top cap wherein the first divider includes channels on an upper surface proximate side edges of the divider for receiving a bottom portion of each of the sides of the second sleeve.

19. The sleeve pack assembly of claim 18 wherein the first divider includes a latching mechanism for securing the bottom portions of the second sleeve to the first divider.

20. A sleeve pack assembly comprising:

a pallet and a top cap, the pallet having a generally rectangular upper surface;

a first sleeve disposed between the pallet and the top cap, the first sleeve having a first side, a second side connected at a first edge to the first side, and a third side connected to a second edge of the second side; and, a second sleeve disposed between the pallet and the top cap, the second sleeve having a first side, a second side connected at a first edge to the first side, and a third side connected to a second edge of the second side wherein the pallet includes channels for receiving a bottom portion of each of the sides of the first sleeve and a bottom portion of each of the sides of the second sleeve.

* * * * *